US007516852B1

(12) United States Patent
Rehurek

(10) Patent No.: US 7,516,852 B1
(45) Date of Patent: Apr. 14, 2009

(54) ROTATABLE HOLDER FOR CONTAINERS

(76) Inventor: Barry Rehurek, 1590 E. Chase Ave., El Cajon, CA (US) 92020

( * ) Notice: Subject to any disclaimer, the term of this patent is extended or adjusted under 35 U.S.C. 154(b) by 0 days.

(21) Appl. No.: 11/654,248

(22) Filed: Jan. 17, 2007

(51) Int. Cl.
*B07C 5/00* (2006.01)

(52) U.S. Cl. ..... 209/630; 209/632; 209/919; 294/68.2; 294/68.27

(58) Field of Classification Search ..... 209/630, 209/632, 919; 294/68.2, 68.27; 414/420, 414/421
See application file for complete search history.

(56) References Cited

U.S. PATENT DOCUMENTS 2,909,297 A * 10/1959 Webster ..... 414/420
3,230,003 A 1/1966 McAfoos, Jr.
3,893,579 A * 7/1975 Glewwe ..... 414/420
4,447,185 A 5/1984 Robinson et al.
4,797,050 A * 1/1989 Habicht ..... 414/420
5,704,711 A * 1/1998 Simmons ..... 366/199
5,895,196 A 4/1999 Forsyth
5,897,283 A 4/1999 Lenguyen
6,808,081 B1 10/2004 Citro

* cited by examiner

*Primary Examiner*—Patrick H Mackey
*Assistant Examiner*—Terrell H Matthews
(74) *Attorney, Agent, or Firm*—Gerald M. Walsh; Kenneth M. Bush; Bush Intellectual Property Law

(57) ABSTRACT

A rotatable container holder for recyclable materials, such as plastic bottles and aluminum cans, having a container holder frame support and a container holder frame attached rotatably to the container holder frame support. The recyclable materials can be inspected, sorted, and transferred by a single user by placing a holding container with recyclables into the container holder frame and rotating the container holder frame so that the user can reach into the holding container and remove items, while allowing the recyclable materials to pour into a receiving container. A cover can also be placed on the container so that the container and container cover can be rotated from a vertical position towards a horizontal position or rotated yet further towards an inverted vertical position, allowing the recyclable materials to tumble back and forth, causing debris among the materials, or liquids within the materials, to fall through openings in the container and container cover.

3 Claims, 5 Drawing Sheets

ROTATABLE HOLDER FOR CONTAINERS

FIELD OF THE INVENTION

This invention relates generally to container holder devices, and more particularly to those container holder devices in which the container can rotate relative to its support structure.

BACKGROUND OF THE INVENTION

Recyclable materials include glass bottles, plastic bottles, and aluminum cans. These types of bottles and cans are delivered to recycling centers which will pay a specific price for each type of recyclable material. Plastic bottles and aluminum cans need to be inspected before they are weighed. In a typical transaction a customer comes to a recycling center with his or her recyclables in plastic garbage bags. The customer sorts the material, placing aluminum cans and plastic bottles into separate wire baskets or containers. These wire baskets are then weighed and the customer is paid according to the price per pound for the specific material.

Some customers perform properly when sorting their plastic bottles and aluminum cans, making sure they are empty. Other customers inadvertently mix items or have liquid in the bottle or can. And yet others intentionally include foreign materials and contaminants in the bottles or cans or in the wire basket in an attempt to receive more money as a result of the increased weight produced by the foreign materials or contaminants.

The use of wire baskets helps in the visual inspection of the recyclables, but is insufficient for adequate identification of foreign materials and contaminants. At present, it takes two people to inspect a customer's recyclables, one who slowly pours the recyclables from a full wire basket into an empty wire basket while another grabs problem materials and discards them. At other times, when bottles or cans are filled with water, these recyclables must be poured several times from one basket to another, whereby the tumbling of the recyclables helps remove the water. Since the baskets weigh about twenty pounds empty and hold up to fifty pounds of recyclables, the present method of inspecting, sorting out foreign materials, and emptying a basket of a specific recyclable into a receiving container is relatively labor intensive, time consuming, and expensive.

There are dumping devices known which are rotatable within the structure which supports them, but they function like rotatable wheel barrows. They are not designed to hold containers such as wire baskets for recyclable materials. What is needed is a holder for recyclable baskets or containers that will allow a single user to rotate the container so that the single user can pour, sort, and/or tumble the recyclable material quickly with little effort.

SUMMARY OF THE INVENTION

The present invention is a rotatable holder for containers, such as, for example, wire baskets used to process recyclable materials. The rotatable container holder has a container holder frame support which has a pair of legs attached to a base. The legs each have a bearing to accommodate an axle. The rotatable container holder also has a container holder frame with a pair of legs attached to a base. The legs are attached rotatably to the axles within the container holder frame support. A container support is attached to the legs of the container holder frame. The container holder frame with its container support, thus, rotates relative to the container holder frame support to which it is rotatably attached. The container support has a pair of arms which provide leverage for a user to rotate the container holder frame. The rotatable container holder can be used to mix, inspect, sort, or transfer recyclable materials. A user inserts a container such as a wire basket into the container support of the container holder frame. The wire basket can be pre-filled with a given type of recyclable material. The user then uses the arms to rotate the container holder frame within the container holder frame support so that the container is rotated from a vertical towards a horizontal position, or rotated yet further to an inverted vertical position as desired.

An advantage of the present invention is a container holder that a single user can operate with little effort to rotate a large container to mix, inspect, sort, or transfer materials rapidly and safely.

Another advantage is a container holder that can position one container adjacent to another container to make a closed container for mixing and tumbling.

Another advantage is a rotatable container holder that is durable and easy to maintain and disassemble.

Another advantage is a rotatable container holder that is simple to manufacture and inexpensive.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
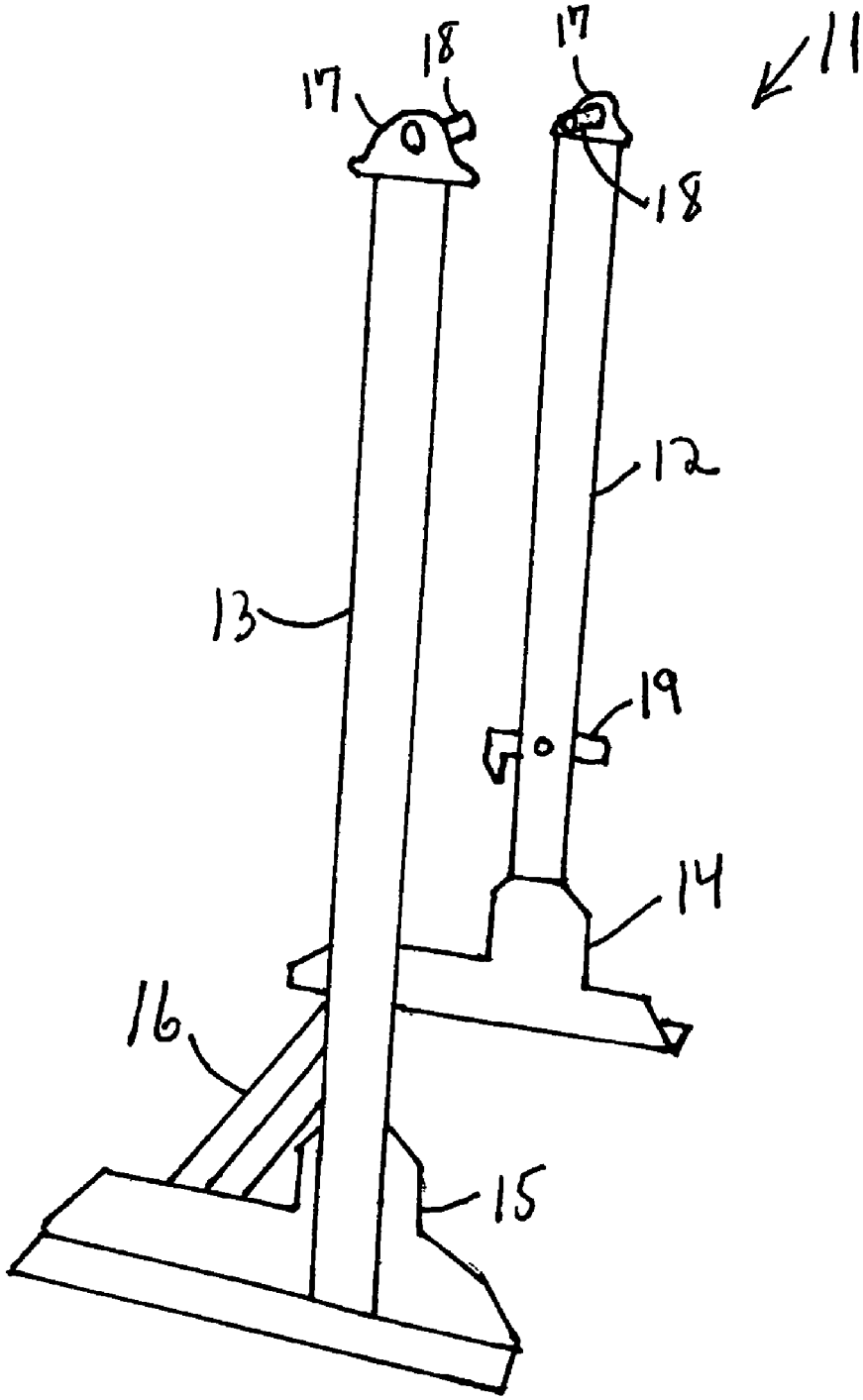
FIG. 1 shows the container holder frame support of the rotatable container holder of the present invention.

FIG. 1 shows the container holder frame support 11 of the rotatable container holder 10 (see FIG. 3) of the present invention. The container holder frame support 11 has a first leg 12 and a second leg 13. First leg 12 has a base plate 14 on one end and second leg 13 has a base plate 15 on one end. A cross brace 16 is attached to base plate 14 and base plate 15. The combination of the base plates 14 and 15 and the cross brace 16 form a base for the container holder support frame 11. Legs 12 and 13 have bearings 17 on the ends of the legs opposite the base plates 14 and 15. The bearings 17 engage axles 18. One or both legs can have a rotatable latch 19.

Figure 2:
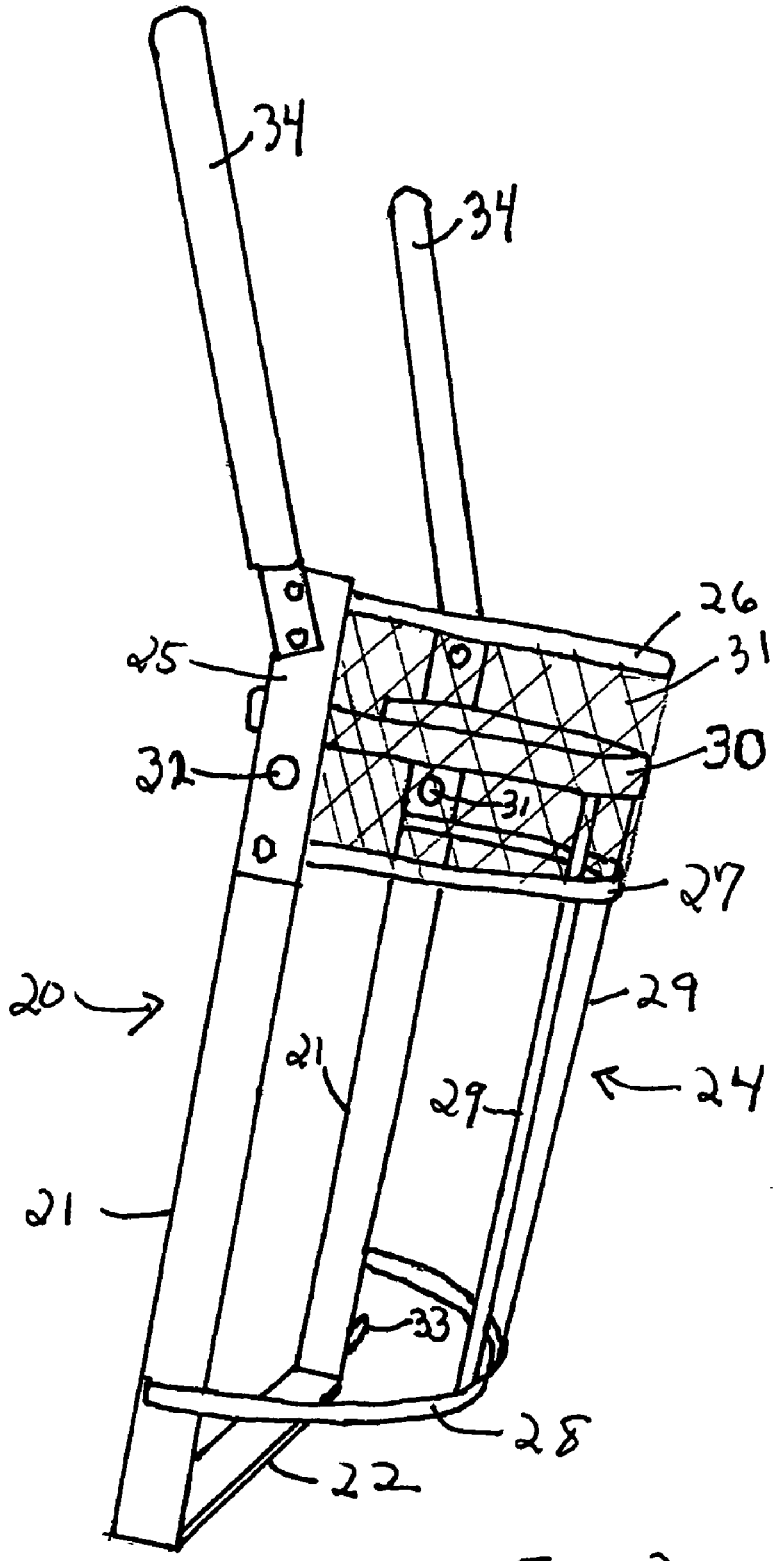
FIG. 2 shows the container holder frame of the rotatable container holder, with the container support attached.

FIG. 2 shows the container holder frame 20 of the rotatable container holder 10 (see FIG. 3) and the container support 24 attached to the container holder frame 20. The container holder frame 20 has a pair of legs 21 attached by a cross brace 22 at one end of each leg. At the opposite ends of the legs 21 brace members 25 are attached. A top circular band 26 and a middle circular band 27 are attached to brace members 25. A bottom circular band 28 is attached to the legs 21 near the cross brace 22. A vertical support circular band 30 is also attached to brace members 25. Vertical support circular band 30 has a ridge or lip (not shown) on its inner surface to prevent a container from moving downward when the container is in a vertical position above the vertical support circular band 30. Vertical support members 29 are attached to the bottom circular band 28, the middle circular band 27, and the vertical support circular band 30. The attachment of the circular bands to the brace members 25 or legs 21 can be by nuts and bolts, or bonding, or welding, and the like. A wire mesh 31 can cover the top circular band 26, the vertical support circular band 30, and the middle circular band 27. Brace members 25 have openings 32 to engage the axles 18 so that container holder frame 20 with its container support 24 is supported rotatably within the container holder frame support 11. The container support 24 has a pair of arms 34 which provide leverage for a user to rotate the container holder frame 20. The arms 34 are shown attached to brace members 25 but could also be attached to legs 21. The arms 34 are, preferably, made of solid steel forming counterweights so that the weight of both arms 34 acts to counterbalance the load in a container, thus greatly reducing the force required to manipulate the loaded container.

Figure 3:
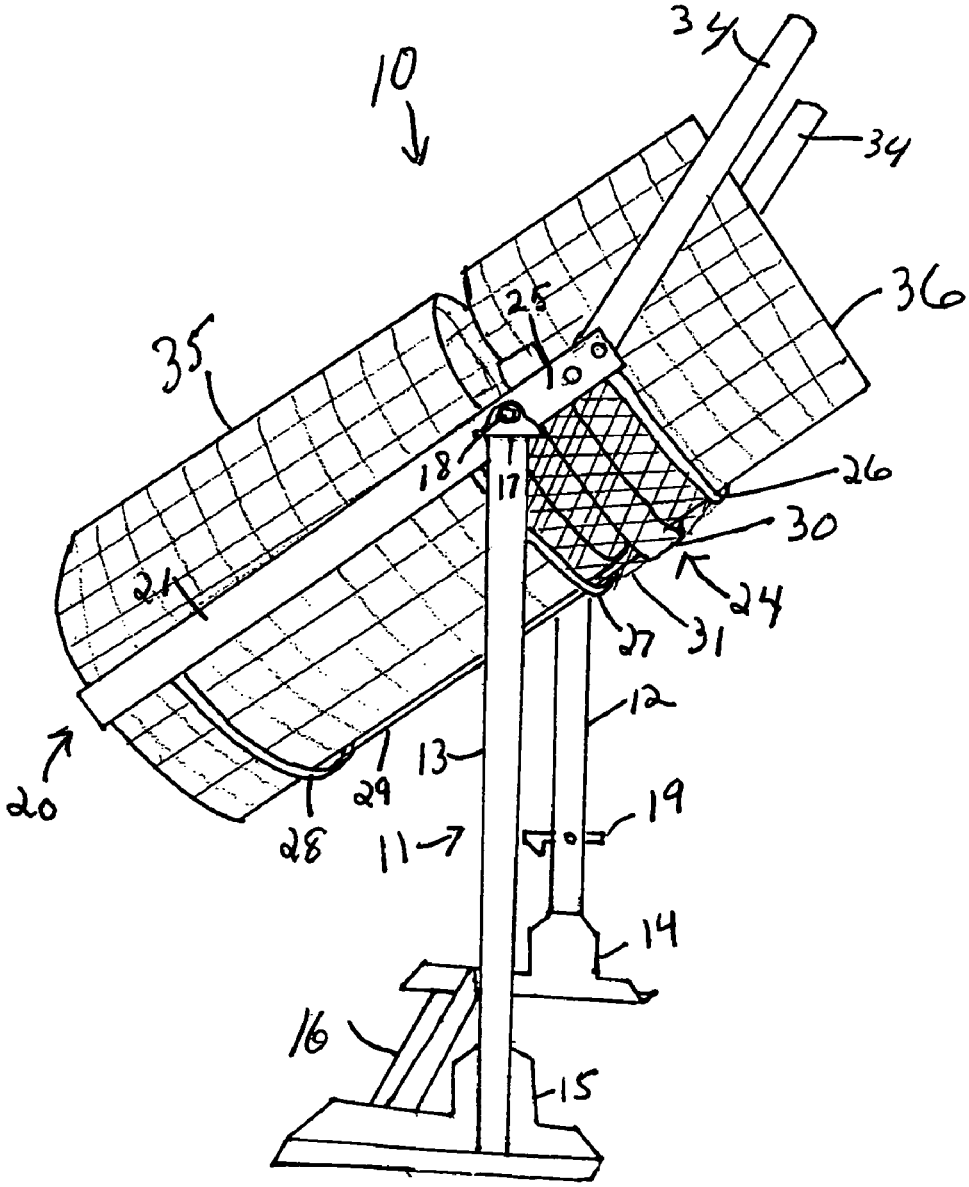
FIG. 3 shows the assembled rotatable container holder of the present invention.

FIG. 3 shows the assembled rotatable container holder 10. The container holder frame 20 is supported in the container holder frame support 11 by engaging axles 18 in openings 32 of brace members 25. A holding container 35, such as a wire mesh basket, can be inserted into container support 24 and is supported on its bottom end by cross brace 22. Holding container 35 can be fastened to container support 20 by cords, hooks, fasteners and the like. Holding container 35 can also rest freely within container support 20. A holding container cover 36 can also be inserted into container support 20, and is prevented from moving downward by engaging a ridge or lip on the inner aspect of vertical support circular band 30 (not shown). As the container holder frame 20 is rotated so that holding container 35 is turned upside down, holding container 35 is prevented from moving downward as it engages the vertical support circular band 30. When holding container 35 is, thus, inverted, holding container cover 36 can be held in place by cords, hooks, fasteners, and the like.

Figure 4A:
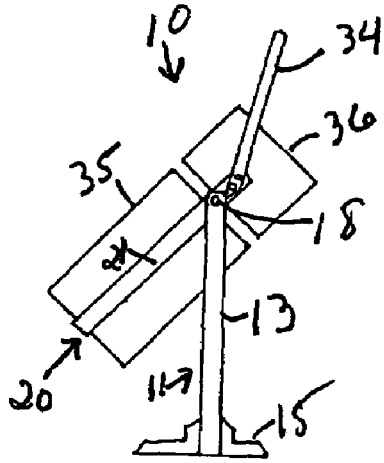
FIGS. 4*a*-4*d* illustrate the method of the present invention for mixing or tumbling materials in containers positioned within the rotatable container holder.
Figure 4B:
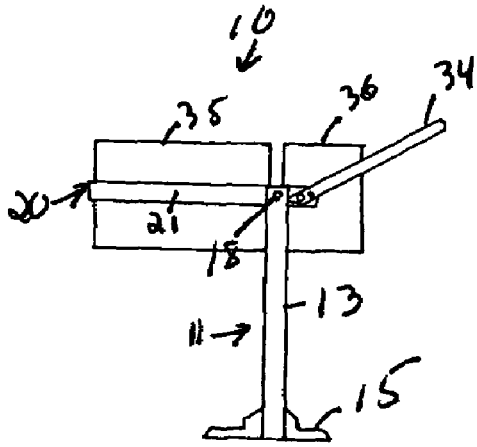
Figure 4C:
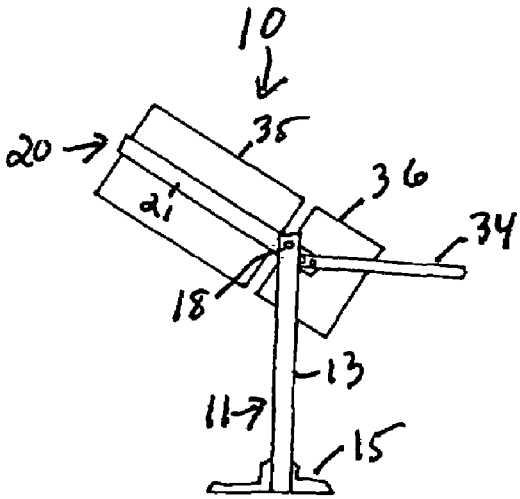
Figure 4D:
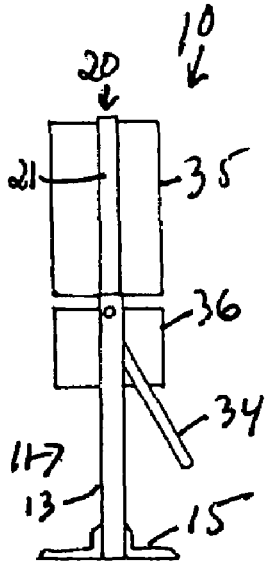

FIGS. 4*a*-4*c* illustrate the method of the present invention for inspecting, mixing, and tumbling materials in a container positioned within the rotatable container holder 10. In FIG. 4*a* a holding container 35 is positioned in the container support 24 and rests on the cross brace 22 of the container holder frame 20. The holding container 35 is, preferably, pre-filled with a specific recyclable material, although the holding container 35 can be filled after it is positioned in the container support 24. A holding container cover 36 is placed into the container support 24 and rests on the vertical support circular band 30. The container holder frame 20 can be rotated within the container holder frame support 11 by a single user from a vertical towards a horizontal position (FIG. 4*b*) and rotated yet further towards an inverted vertical position (FIG. 4*c*) and then to a full inverted vertical position (FIG. 4*d*). In an inverted vertical position the top edge of holding container 35 can engage vertical support circular band 30 which will prevent the holding container 35 from sliding downwards. As the holding container 35 is, thus, rotated by the user, the recyclable materials will fall from the holding container 35 into the holding container cover 36. As the process is reversed from the position shown in FIG. 4*d* to the position shown in 4*a*, the recyclable materials will fall back into the holding container 35. This process can be repeated as often as desired to tumble and mix the recyclable materials so that debris among the recyclable materials or liquids within the recyclable materials will fall through openings in the holding container 35 and the holding container cover 36.

Figure 5B:
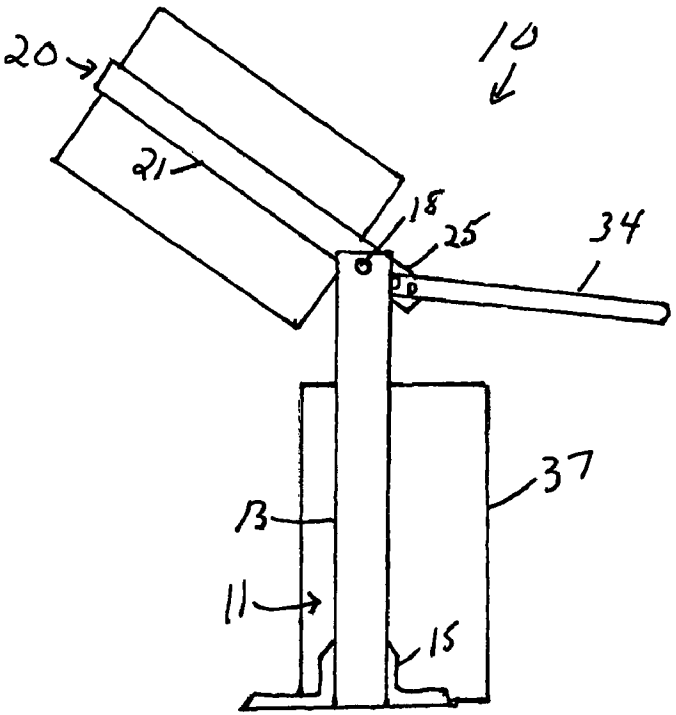
FIGS. 5*a*-5*b* illustrate the method of the present invention for inspecting, sorting, and transferring materials in a container positioned within the rotatable container holder.
Figure 5A:
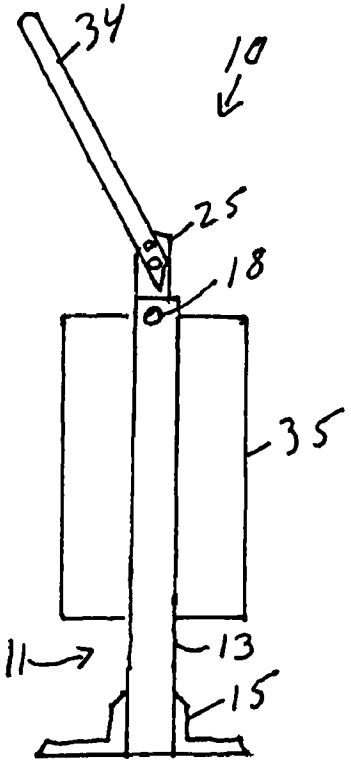

FIGS. 5*a* and 5*b* illustrate the method of the present invention for inspecting, sorting, and transferring materials in a container positioned within the rotatable container holder 10. In FIG. 5*a* a holding container 35 is positioned in the container support 24 and rests on the cross brace 22 of the container holder frame 20, after the holding container 35 is pre-filled with a specific recyclable material. A receiving container 37 is positioned next to the holding container 35. The container holder frame is rotated within the container holder frame support 11 by a single user from the vertical position shown in FIG. 5*a* towards a horizontal position or beyond as shown in FIG. 5*b*. The user then can reach into holding container 35 and sort or remove items as desired. The user can simultaneously pour or transfer the recyclable materials into the receiving container 37 by lowering arm 34 as desired.

The foregoing description has been limited to specific embodiments of this invention. It will be apparent, however, that variations and modifications may be made by those skilled in the art to the disclosed embodiments of the invention, with the attainment of some of all of its advantages and without departing from the spirit and scope of the present invention. For example, the rotatable container holder 10 can be used without a container support 24 by fastening the holding container 35 directly to the container holder frame 20, and the holding container cover 36 to the holding container 35. Axles 18 may be attached to the brace members 25 instead of to bearings 17. The rotatable container holder can be constructed of any suitable materials, including metal, plastic, wood, or a combination thereof. The arms 34 can be positioned at any desired angle on the container holder frame legs 21 or brace members 25. A vertical support circular band 30 can be attached to the legs 21 of the container holder frame 20 in the absence of a container support 24.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A rotatable container holder comprising:

a) a container holder frame support having a first pair of legs, each leg having a base plate in which said base plates are connected to each other by a cross brace to form a base for said container holder frame support;

b) a container holder frame having a second pair of legs attached rotatably to said first pair of legs;

c) one or more arms fixed to said container holder frame to rotate said container holder frame within said container holder frame support from a vertical position towards a horizontal position or towards an inverted vertical position, wherein said one or more arms are counterweights to counterbalance a load in a container; and d) a vertical support circular band attached to said second pair of legs of said container holder frame, wherein said vertical support circular band has a ridge or lip to prevent a container from falling vertically when said container holder frame or said container is in a vertical position above said vertical support circular band.

2. A rotatable container holder comprising:

a) a container holder frame support having a first pair of legs, each leg having a base plate in which said base plates are connected to each other by a cross brace to form a base for said container holder frame support;

a container holder frame having a second pair of legs attached rotatably to said first pair of legs;

c) a container support attached to said second pair of legs of said container holder frame;

d) one or more arms fixed to said container holder frame to rotate said container holder frame within said container holder frame support from a vertical position towards a horizontal position or towards an inverted vertical position, wherein said one or more arms are counterweights to counterbalance a load in a container; and e) a vertical support circular band attached to said second pair of legs of said container holder frame, wherein said vertical support circular band has a ridge or lip to prevent a container from falling vertically when said container holder frame or said container is in a vertical position above said vertical support circular band.

3. A rotatable container holder comprising:

a) a container holder frame support having a first pair of legs, each leg having a base plate in which said base plates are connected to each other by a cross brace to form a base for said container holder frame support;

b) a container holder frame having a second pair of legs attached rotatably to said first pair of legs;

c) a container support attached to said second pair of legs of said container holder frame;

d) a bearing on each leg of said first pair of legs to engage axles for the rotation of said container holder frame;

e) a vertical support circular band attached to said second pair of legs of said container holder frame, wherein said vertical support circular band has a ridge or lip to prevent a container from falling vertically when said container holder frame or said container is in a vertical position above said vertical support circular band; and f) one or more arms fixed to said container holder frame or to said container support to rotate said container holder frame within said container holder frame support from a vertical position towards a horizontal position or towards an inverted vertical position, wherein said one or more arms are counterweights to counterbalance a load in a container.

* * * * *